United States Patent [19]

Nadel

[11] Patent Number: 4,703,892

[45] Date of Patent: Nov. 3, 1987

[54] WATER SHOOTING AMUSEMENT DEVICE

[75] Inventor: Melvin Nadel, New York, N.Y.

[73] Assignee: Nadel & Sons Toy Corp., New York, N.Y.

[21] Appl. No.: 867,967

[22] Filed: May 29, 1986

[51] Int. Cl.[4] ..... B05B 1/00; B65D 1/32

[52] U.S. Cl. ..... 239/211; 239/327; 222/78; 446/368; D9/302; D9/310

[58] Field of Search ..... 446/368; 239/211, 327, 239/337, 525; 222/78; D9/302, 310

[56] References Cited

U.S. PATENT DOCUMENTS

| | | | |
|---|---|---|---|
| 394,775 | 12/1888 | Kneuper | 239/327 |
| 559,293 | 4/1896 | Kitchen | 446/368 |
| 1,324,646 | 12/1919 | Clements | 446/368 X |
| 3,050,902 | 8/1962 | Glass et al. | 446/368 |
| 4,575,350 | 3/1986 | Hippely et al. | 446/368 |

FOREIGN PATENT DOCUMENTS

| | | | |
|---|---|---|---|
| 671335 | 12/1929 | France | 239/211 |

*Primary Examiner*—Andres Kashnikow
*Assistant Examiner*—Mary Beth O. Jones
*Attorney, Agent, or Firm*—Cobrin & Godsberg

[57] ABSTRACT

A water shooting device includes a container for holding water; a tube fitting device removably secured to the container in a fluid sealing manner; a tube connected to the tube fitting device and extending into the container for shooting the water from a free end of the tube when the container is compressed; a plurality of links serially and pivotally connected to each other, in surrounding relation to the tube, the rearward-most link being pivotally connected to the tube fitting device; a grasping head in the form of a snake's head pivotally connected to the forward-most link for aiming the free end of the tube; and a restriction tube of a narrow diameter positioned in the free end of the tube for narrowing and increasing the speed of the water emitted from the free end of the tube.

6 Claims, 20 Drawing Figures

FIG. 13
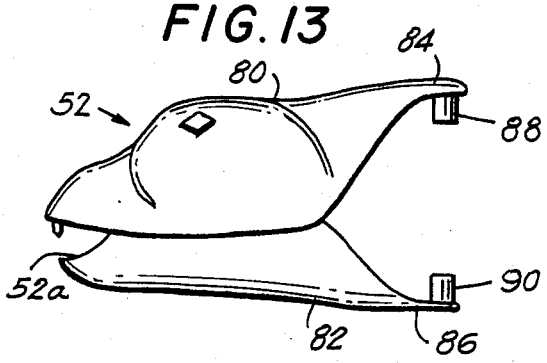
FIG. 14
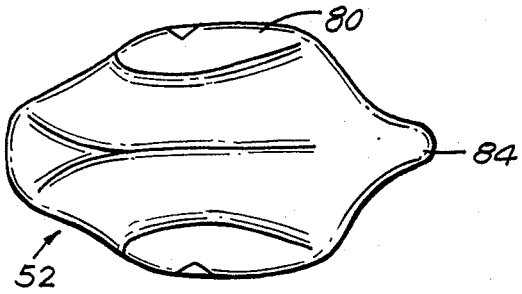
FIG. 17
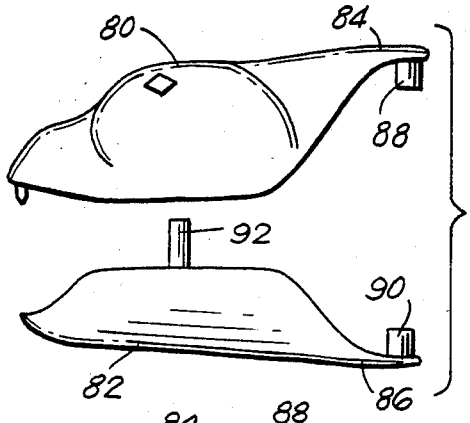
FIG. 15
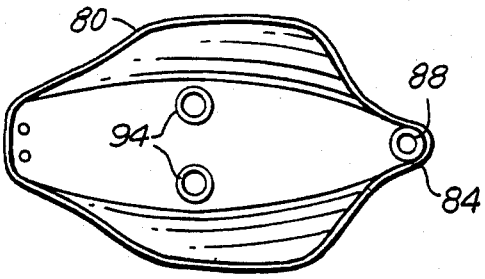
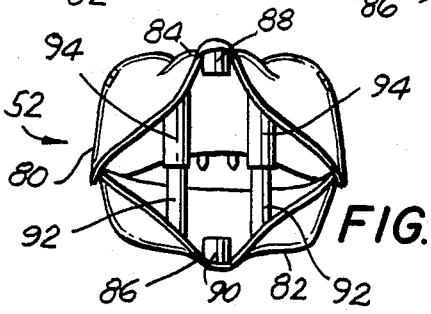
FIG. 18
FIG. 16
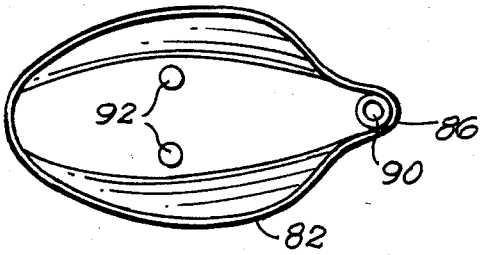
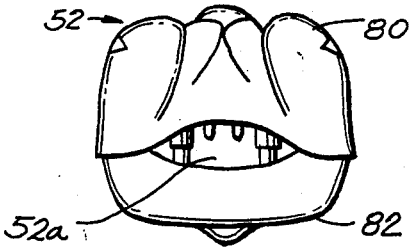
FIG. 19

WATER SHOOTING AMUSEMENT DEVICE

BACKGROUND OF THE INVENTION

This invention relates generally to water shooting amusement devices and, more particularly, is directed to a water shooting amusement device which can be easily and readily aimed at a target.

Water shooting devices for amusement purposes are well known in the art. Generally, such devices are in the form of guns or the like. This, however, is disadvantageous for a number of reasons. First, it is often difficult for young children to overcome the spring pressure on the trigger of the gun with only one or two fingers, in order to shoot the water. Secondly, the use of a gun may have a deleterious psychological and sociological affect on a child.

OBJECTS AND SUMMARY OF THE INVENTION

Accordingly, it is an object of the present invention to provide a water shooting device that is easy to aim and shoot.

It is another object of the present invention to provide a water shooting device which can be aimed in different directions by means of flexible links.

It is still another object of the present invention to provide a water shooting device that can be formed in the configuration of a snake.

In accordance with an aspect of the present invention, a water shooting device includes compressible container means for holding a liquid; tube means connected to the container means for shooting the liquid from a free end of the tube means when the container means is compressed; and guide means surrounding the tube means for aiming the free end of the tube means.

Further, the guide means includes a plurality of links pivotally connected to each other in series, one link at a first end of the guide means being connected to the container means, and a grasping element in the form of a snake's head pivotally connected to another link at a second, opposite end of the guide means, with the free end of the tube means extending out of the grasping element to simulate a tongue.

The above and other objects, features and advantages of the present invention will become readily apparent from the following detailed description of the invention which is to be read in connection with the accompanying drawings.

BRIEF DESCRIPTION OF THE DRAWINGS

FIG. 13 is a side elevational view of the grasping head of the water shooting device of FIG. 1;

FIG. 14 is a top plan view of the grasping head of FIG. 13;

FIG. 15 is a bottom plan view of the upper head shell of the grasping head of FIG. 13;

FIG. 16 is a top plan view of the lower head shell of the grasping head of FIG. 13;

FIG. 17 is a side elevational view showing the assembly of the upper and lower head shells of the grasping head of FIG. 13;

FIG. 18 is a rear plan view of the grasping head of FIG. 13;

FIG. 19 is a front plan view of the grasping head of FIG. 13; and

DETAILED DESCRIPTION OF A PREFERRED EMBODIMENT

Figure 1:
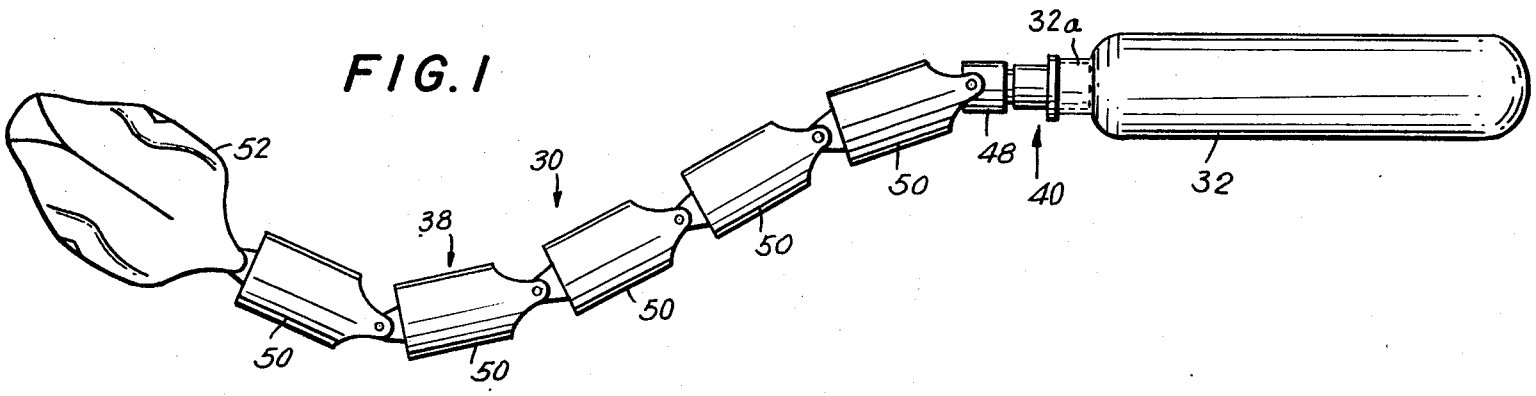
FIG. 1 is a to plan view of a water shooting device according to the present invention.
Figure 2:
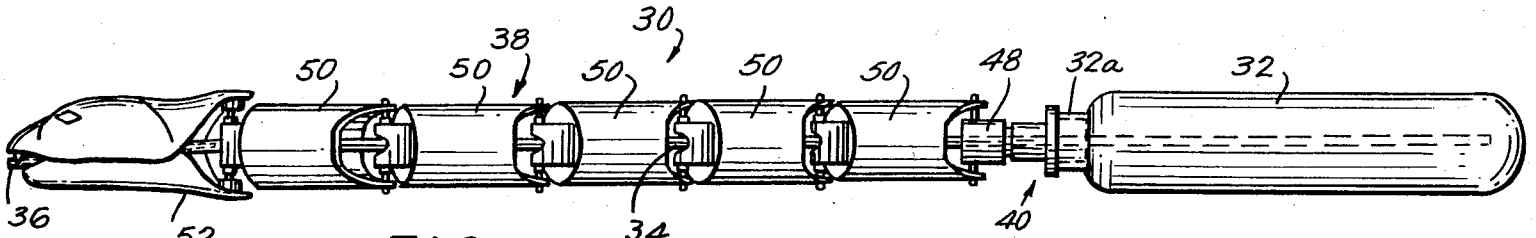
FIG. 2 is a side elevational view of the water shooting device of FIG. 1.
Figure 20:
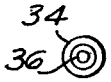
FIG. 20 is an enlarged, front plan view of the free end of the tube of the water shooting device of FIG. 1 with the restriction therein.
Figure 4:
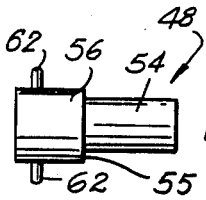
FIG. 4 is a side elevational view of the tube fitting device of the water shooting device of FIG. 1.
Figure 6:
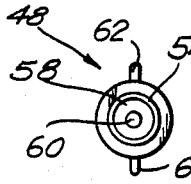
FIG. 6 is a rear plan view of the tube fitting device of FIG. 4.
Figure 5:
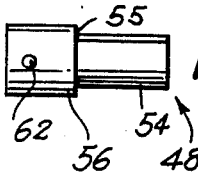
FIG. 5 is a top plan view of the tube fitting device of FIG. 4.
Figure 7:
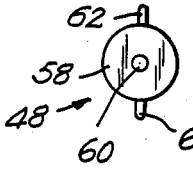
FIG. 7 is a front plan view of the tube fitting device of FIG. 4.
Figure 8:
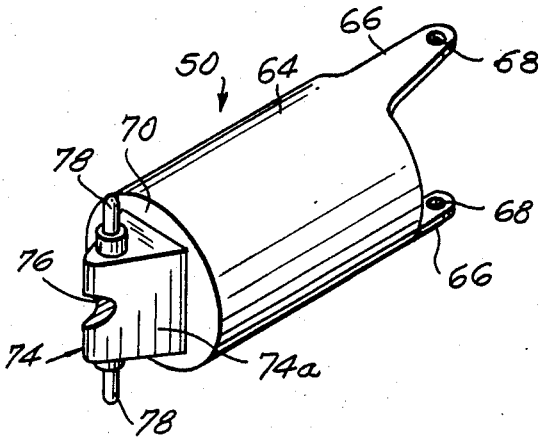
FIG. 8 is a perspective view of a link of the water shooting device of FIG. 1.
Figure 9:
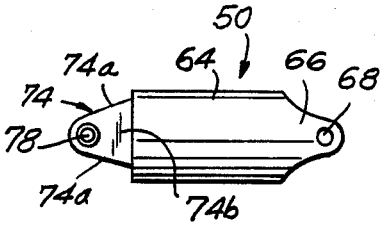
FIG. 9 is a top plan view of the link of FIG. 8.
Figure 10:
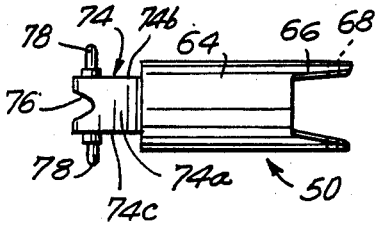
FIG. 10 is a side elevational view of the link of FIG. 8.
Figure 11:
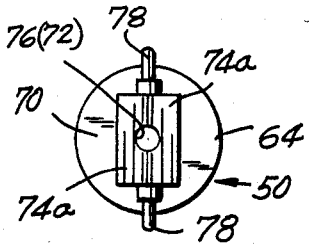
FIG. 11 is a front plan view of the link of FIG. 8.
Figure 12:
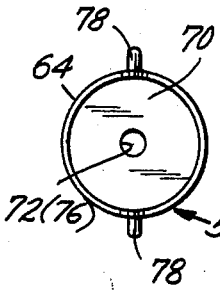
FIG. 12 is a rear plan view of the link of FIG. 8.

Referring to the drawings in detail, and initially to FIGS. 1 and 2 thereof, a water shooting device 30 for amusement purposes according to the present invention generally includes a container 32 for holding water, a tube 34 connected at one end to container 32, a restriction 36 (FIGS. 2 and 20) in the opposite or free end of tube 34, a guide 38 surrounding and connected to tube 34 for aiming the free end of tube 34 when shooting water. Although the liquid in container 32 will be described as water throughout the application, it will be appreciated that the present invention can be used with any non-viscous liquid.

As shown in FIGS. 1 and 2, container 32 is of a generally elongated, cylindrical configuration, and is made of a resilient, elastic material, such as plastic or the like, whereby the walls of container 32 can be depressed inwardly to force water through tube 34, with the walls of container 32 returning to their original configuration, as shown, when the external squeezing force is removed. Container 32 includes a forward end **32*a* of a lesser diameter, which is open, and a rigid, cylindrical connector 40 is secured to the forward end 32*a* of container 32 in fluid communication with the inside of container 32**.

Figure 3:
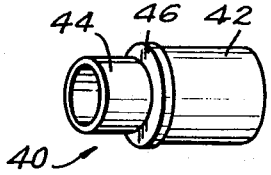
FIG. 3 is a perspective view of the connector for the container of the water shooting device of FIG. 1.

Specifically, connector 40, as shown in FIG. 3, includes a first hollow, cylindrical section 42, a second hollow, cylindrical section 44 in fluid communication with first cylindrical section 42 and a ring abutment 46 surrounding second cylindrical section 44 and having a diameter larger than the diameter of first cylindrical section 42. Forward end **32*a* of container 32 is stretched over first cylindrical section 42 in a fluid sealing relation and, in this regard, ring abutment 46 limits the extent that forward end 32*a* of container 32 can be fit over connector 40**.

Guide 38 includes a tube fitting device 48 which connects tube 34 to container 32, a plurality of links 50 hingedly connected in series to tube fitting device 48 and a grasping head 52 hingedly connected to the forward-most, free link 50.

Referring to FIGS. 4–7, tube fitting device 48 includes a hollow, cylindrical first section 54 and an integral, hollow, cylindrical second section 56 connected thereto. Since first section 54 has an outside diameter less than that of second section 56, an annular limiting shoulder 55 is formed. First section 54 also has an outside diameter slightly less than the inside diameter of second cylindrical section 44 of connector 40 and fits therein in a fluid sealing manner. However, the fit between second cylindrical section 44 of connector 40 and first section 54 of tube fitting device 48 permits disconnection of tube fitting device 48 from connector 40, so that container 32 can be refilled with water. The extent of travel of first section 54 within second cylindrical section 44 of connector 40 is limited by shoulder 55.

The forward end of second section 56 is provided with an end sealing wall 58 having a central aperture 60 through which tube 34 extends in a fluid sealing manner, that is, tube 34 has an outside diameter substantially equal to the diameter of aperture 60 so that tube 34 is slightly compressed when fit within aperture 60, thereby forming a fluid tight seal. Accordingly, when water shooting device 30 is fully assembled, water can only leave container 32 through tube 34. Tube fitting device 48 also includes two diametrically opposite pivot pins 62 extending radially outwardly from second section 56 thereof, the purpose of which will be made apparent from the description which follows.

Referring to FIGS. 8–12, each link 50 is formed by a hollow, cylindrical main body 64 surrounding tube 34. Two fins 66 rearwardly extend from diametrically opposite rear ends of main body 64, each fin 66 having a transverse aperture 68. The opposite or front end of main body 64 is closed by a wall 70 which has a centrally positioned aperture 72 therein. A triangular, tent-shaped, tube guiding section 74 is secured to front wall 70 and includes an aperture 76 formed by cut-away sections in side surfaces **74*a* of tube guiding section 74. Apertures 72 and 76 are axially aligned and have diameters larger than the diameter of tube 34 to permit tube 34 to move longitudinally with respect to water shooting device 30 and to permit twisting of tube 34. Two pivot pins 78 extend outwardly from top and bottom surfaces 74*b* and 74*c*, respectively, of tube guiding section 74**, the purpose of which will be made apparent from the description which follows.

As shown in FIGS. 13–19, grasping head 52 is formed in the configuration of a hollow snake's head, and includes a concave, upper head shell 80 and a concave, lower head shell 82 connected thereto which, when connected together, form an open mouth **52*a* at the front of the snake's head. Upper head shell 80 includes an upwardly, tapered tail section 84, and lower head shell 82 likewise includes a downwardly, tapered tail section 86 in opposing relation to tail section 84. Hollow pin receiving posts 88 and 90 extend toward each other from tail sections 84 and 86, respectively, for receiving pivot pins 78 from the adjacent, forward-most link 50**.

Lower head shell 82 includes two spaced pins 92, and upper head shell 80 includes two similarly spaced pin receiving posts 94 for receiving pins 92 in a tight fitting manner, so as to secure upper head shell 80 and lower head shell 82 together.

To assemble water shooting device 30, the forward end **32*a* of container 32 is secured over first cylindrical section 42 of connector 40. Tube 34 is positioned through aperture 60 of tube fitting device 48, and first section 54 of tube fitting device 48 is fit within second cylindrical section 44 of connector 40, such that tube 34 extends within container 32, as shown in dashed lines in FIG. 2. As so assembled thus far, water within container 32 can only travel through tube 34**.

Links 50 are then serially positioned in surrounding relation to tube 34, such that pivot pins 62 of tube fitting device 48 pivotally fit within apertures 68 of the rearward-most link 50. Then, pivot pins 78 of each link 50 are pivotally fit within the apertures 68 of the next forwardly positioned link 50, so that links 50 are all pivotally connected to each other, with tube 34 extending through apertures 72 and 76 of the serially connected links 50.

Next, grasping head 52 is positioned over the free end of tube 34, with the free end of tube 34 extending out of the mouth **52*a* of grasping head 52. Specifically, pivot pins 78 of the forward-most link 50 are pivotally fit within pin receiving posts 88 and 90 of grasping head 52. Also, restriction 36, which is a reduced diameter tube, is fit within the free end of tube 34**.

In operation, connector 40 is disconnected from tube fitting device 48, and container 32 is filled with water. Then tube fitting device 48 and connector 40 are reconnected, with tube 34 extending into container 32. Water shooting device 30 is then aimed by grasping head 52, and then, container 32 is squeezed, whereby the water therein is forced outwardly through the free end of tube 34. Because of restriction 36, the water is forced out in a thin, fast stream.

In use, aiming of the invention can be readily and easily achieved by a child. In addition, a gentle squeezing action on container 32 results in a long, sharp spray being emitted from the free end of tube 34. Further, the problem of young children overcoming the spring pressure on the trigger of water gun with only one or two fingers, in order to shoot the water, is overcome. The psychological and sociological affect of a child using a gun is also avoided.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention, as defined by the appended claims.

What is claimed is:

1. A liquid shooting device comprising:

compressible container means for holding a liquid;

tube means connected to said container means for shooting said liquid from a free end of said tube means when said container means is compressed; and guide means surrounding said tube means for aiming the free end of said tube means, said guide means including a plurality of links pivotally connected to each other in series, one link at a first end of said guide means being connected to said container means, and a grasping element pivotally connected to another link at a second, opposite end of said guide means, with the free end of said tube means extending out of said grasping element, and further including tube fitting means removably secured to said container means in a fluid sealing manner for pivotally connecting said one link to said container means.

2. A liquid shooting device according to claim 1, wherein said grasping element is in the form of a head having a mouth and wherein said free end of said tube means simulates a tongue.

3. A liquid shooting device according to claim 2, wherein said head has the configuration of a snake's head.

4. A liquid shooting device according to claim 1, further comprising restriction means at the free end of said tube means for narrowing and increasing the velocity of a stream of liquid shot from the free end of said tube means.

5. A liquid shooting device according to claim 1, wherein said restriction means includes a restriction tube having an inner diameter smaller than the inner diameter of said tube means and positioned within the free end of said tube means.

6. A liquid shooting device according to claim 1, wherein said container means is made of a flexible resilient material.

* * * * *